US006468070B1

(12) United States Patent
Jon

(10) Patent No.: US 6,468,070 B1
(45) Date of Patent: Oct. 22, 2002

(54) MULTI-PURPOSE GAS LIGHTER WITH IGNITION-RESISTANT FUNCTION

(75) Inventor: Jong-Koo Jon, Inchon (KR)

(73) Assignee: Calico Brands, Inc., Ontario, CA (US)

( * ) Notice: Subject to any disclaimer, the term of this patent is extended or adjusted under 35 U.S.C. 154(b) by 0 days.

(21) Appl. No.: 09/673,773

(22) PCT Filed: May 18, 1999

(86) PCT No.: PCT/US99/11003

§ 371 (c)(1),
(2), (4) Date: Oct. 18, 2000

(87) PCT Pub. No.: WO99/60309

PCT Pub. Date: Nov. 25, 1999

(30) Foreign Application Priority Data

May 20, 1998 (KR) ..... 98/8360

(51) Int. Cl.[7] ..... F23D 11/36
(52) U.S. Cl. ..... 431/153; 431/255
(58) Field of Search ..... 431/153, 255, 431/344, 277, 345, 254; 251/77, 353

(56) References Cited

U.S. PATENT DOCUMENTS

| | | | | |
|---|---|---|---|---|
| 3,493,313 A | | 2/1970 | Schlamp | 431/255 |
| 3,576,471 A | | 4/1971 | Schumacher | 431/255 |
| 3,719,447 A | | 3/1973 | Dessoy | 431/254 |
| 4,502,465 A | | 3/1985 | Yoshinaga et al. | 431/255 |
| 4,516,933 A | | 5/1985 | Buzzi | 431/255 |
| 4,538,983 A | | 9/1985 | Zeller et al. | 431/255 |
| 4,832,596 A | | 5/1989 | Morris, Sr. | 431/153 |
| 4,859,172 A | | 8/1989 | Nitta | 431/153 |
| 5,035,608 A | | 7/1991 | Parren | 431/153 |
| 5,066,220 A | * | 11/1991 | Vick | 431/153 |
| 5,092,764 A | | 3/1992 | McDonough et al. | 431/153 |
| 5,199,865 A | | 4/1993 | Liang | 431/255 |
| 5,236,351 A | | 8/1993 | Tien | 431/153 |
| 5,308,240 A | * | 5/1994 | Lowenthal | 431/255 |
| 5,322,433 A | | 6/1994 | Shike et al. | 431/344 |
| 5,348,467 A | | 9/1994 | Piffath | 431/153 |
| 5,401,163 A | | 3/1995 | Yamazaki | 431/153 |

(List continued on next page.)

FOREIGN PATENT DOCUMENTS

WO WO 90/12254 * 10/1990

*Primary Examiner*—Henry Bennett
*Assistant Examiner*—Josiah C. Cocks
(74) *Attorney, Agent, or Firm*—Trojan Law Offices

(57) ABSTRACT

A utility lighter (1) with an ignition-resistant mechanism. The ignition-resistant function is performed by a cam mechanism (60) having a hub (61). The hub has three integral projections: the cam lever (80), the fuel-release lever (70), and the return spring (90). Integral to the cam lever is the safety button (120) which when depressed disengages the cam lever (80) from the stopper tab (110) of the trigger (100). The trigger (100) also has an inclined surface (111) below the stopper tab (110) which the cam lever (80) engages after the safety button (120) is depressed and the trigger (100) is pulled. Once the trigger (100) is pulled, the cam lever (80) moves along the inclined surface (111) rotating the cam mechanism (60). When the cam mechanism (60) is rotated the fuel-release lever (70) opens the fuel-release valve (31) allowing fuel to transfer through to the lighting rod (16). When the safety button is released the return spring (90) urges the cam mechanism (60) to rotate back to the initial locked position.

11 Claims, 4 Drawing Sheets

U.S. PATENT DOCUMENTS

| | | | | | |
|---|---|---|---|---|---|
| 5,417,571 | A | | 5/1995 | Kvalseth | 431/153 |
| 5,454,713 | A | | 10/1995 | Lee | 431/153 |
| 5,460,521 | A | | 10/1995 | Tsai | 431/255 |
| 5,492,468 | A | | 2/1996 | Cirami | 431/153 |
| 5,496,169 | A | | 3/1996 | Chen | 431/153 |
| 5,531,592 | A | | 7/1996 | Tsai | 431/255 |
| 5,616,022 | A | | 4/1997 | Moran, IV | 431/344 |
| 5,655,901 | A | | 8/1997 | Makoto | 431/153 |
| 5,697,775 | A | | 12/1997 | Saito et al. | 431/153 |
| 5,738,507 | A | | 4/1998 | Mifune | 431/344 |
| 5,865,614 | A | * | 2/1999 | Hsu | 431/255 |
| 5,980,242 | A | | 11/1999 | Man | 431/344 |
| 6,012,916 | A | * | 1/2000 | Liang | 431/153 |
| 6,042,367 | A | | 3/2000 | Saito et al. | 431/153 |
| 6,050,810 | A | * | 4/2000 | Huang | 431/153 |
| 6,168,420 | B1 | * | 1/2001 | Sung | 431/255 |
| 6,315,550 | B1 | * | 11/2001 | Sher | 431/153 |

* cited by examiner

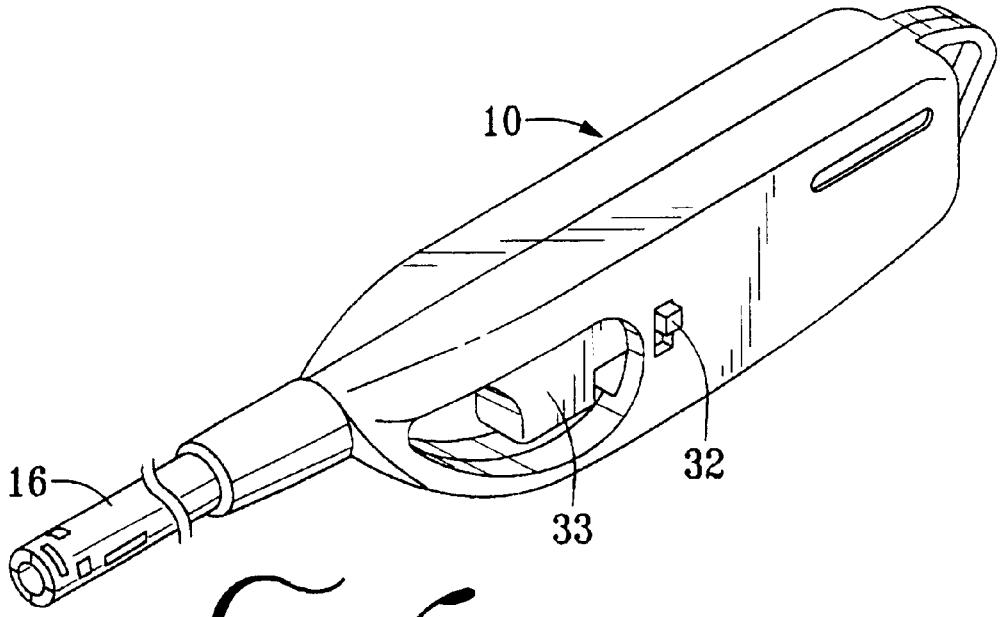
FIG. 6
PRIOR ART
FIG. 7
PRIOR ART
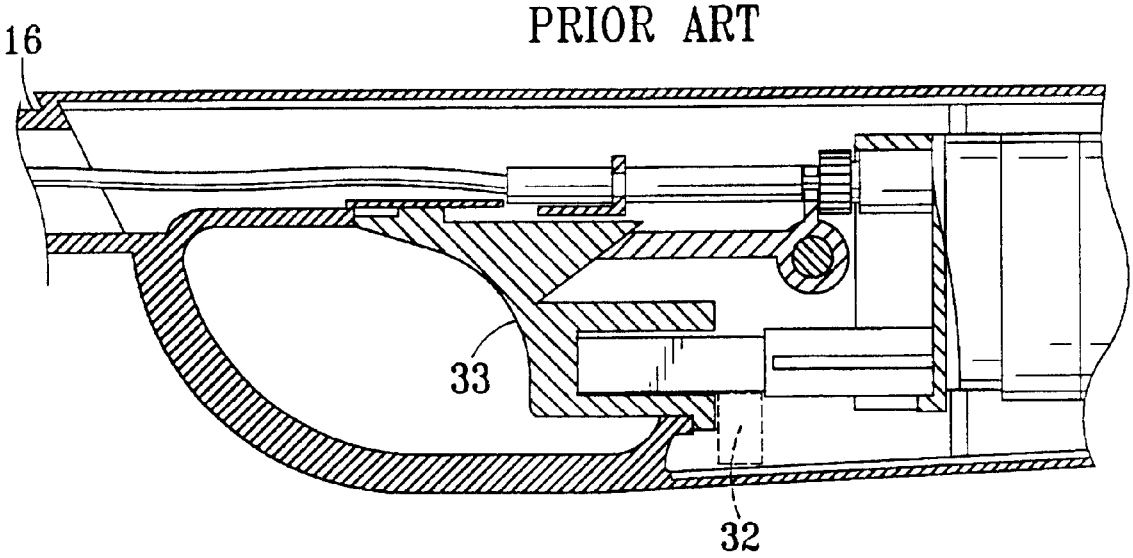

MULTI-PURPOSE GAS LIGHTER WITH IGNITION-RESISTANT FUNCTION

BACKGROUND OF INVENTION

1. Field of the Invention

This invention relates to generally to utility lighters and more specifically to utility lighters which contain a safety feature making the lighter child-resistant.

2. Background Art

Utility lighters are very useful and have become quite prevalent in modern times. Utility lighters of the type described herein generally contain a handle and an elongated lighting rod. The shape and operation of utility lighters allow for several advantages over normal means of producing a flame. Most significantly, due to the elongated nature of the lighting rod, utility lighters enable the operator to stand a safe distance away from the object to be ignited before actuating the lighter, thus avoiding a large number of potential accidents. In addition, utility lighters allow a flame to be produced in hard-to-reach or narrow places, where the human hand holding a match would not normally fit. Still, in the hands of children, or others who do not know how to safely and properly operate the lighter, such lighters are as dangerous as any other spark and/or flame-producing device. Therefore, a need has been realized to equip utility lighters with safety features that minimize accidental or improper use by inexperienced persons, especially young children.

Many inventions have been created to address this safety-related concern. Generally, these inventions have sought to introduce safety mechanisms that disable automatic operation of either the spark-generation and/or the fuel-release function of the lighter. For example, some utility lighters provide for a blocking mechanism, where the actuating trigger (33) (FIGS. 6 and 7) is blocked from moving the required distance for a spark to be generated. In these lighters, the locking mechanism is normally deactivated by sliding an "on/off" (32) switch to the "on" position, or by other means, so as to remove the impediment from the actuating trigger's operating path.

Although utility lighters of the type described above provide some level of safety, there is much room for improvement. Specifically, in these lighters, once the locking means (e.g., the on/off switch) is disabled, the lighter remains in the unlocked state until the locking mechanism is activated again. Therefore, if the operator disables the locking mechanism in order to use the lighter, and then forgets to re-lock the lighter, the safety feature of the lighter is rendered useless, until the locking mechanism is again activated.

Other inventions have attempted to address the safety-related issues by impeding, not the operation of the trigger, but that of the fuel-release mechanism. Of course, a utility lighter containing such a mechanism would inhibit flame generation in the locked position as no fuel would be released until the locking mechanism has been deactivated. However, in these types of lighters, nothing prevents a spark from being generated. As such, the safety goals are only partially met in these types of lighters since young children handling the lighter could still create fires by operating the lighter in close proximity to a source of fuel or near carpets, paper, or other flammable material.

In order to address the above problems, some inventions have introduced locking mechanisms that are activated automatically after each use of the lighter. As such, in these lighters, two states of operation exist: the locked state and the operable state. In the locked state, neither a spark nor a flame can be generated. In contrast, in the operable state, the lighter is no longer locked, so that a flame can be generated.

Therefore, there is a need for a device that not only achieves the stated safety goals in generating a flame, but also makes it difficult for inexperienced users and/or young children to sustain the flame. The invention described herein offers such a combination. The invention requires that a safety button, protruding generally from the top portion of the lighter housing shell, be depressed simultaneously with a trigger before a flame can be produced.

SUMMARY OF THE INVENTION

The primary object of this invention is to provide a safety mechanism for utility lighters so that children or inexperienced users will be less likely to inadvertently activate the lighter. Such a safety feature is especially important because young children often play with lighters as toys and because lighters have mechanically moveable parts that make them attractive to children as toys.

Another object of the present invention is to prevent the generation of not only a flame, but even a spark. As noted previously, in a lighter where only the fuel-release mechanism is inhibited in the locked state, young children playing with the lighter can still use the lighter to create sparks. Depending on the child's surroundings, this can lead to the start of accidental fires if the child is operating the lighter near paper products or any other source of flammable material.

A further object of the invention described herein is to provide an improved device for maximizing safety in utility lighters without compromising ease of use. To this end, the addition of a safety button creates a simple additional step which, for the intended user, leaves the operation of the utility lighter as simple as it has always been to operate a regular utility lighter with no safety feature, yet, creates an additional mental step which acts as a deterrent for non-intended users.

Another object of this invention is to reduce the risk of unintended fires, especially by young children, by making it impossible for the flame to continue to burn unless two (2) separate functions are performed simultaneously and operation of a trigger is continued without interruption.

A final object of the present invention is to meet all of its safety goals while, at the same time, it maximizes ease of manufacturing and minimizes costs associated with manufacturing of parts.

The invention meets its objectives by providing a cam mechanism that integrates several structural elements. In the preferred embodiment, the cam mechanism consists of a cam lever, a fuel-release lever, and a return spring. Most significantly from a safety standpoint, the cam mechanism contains a cam lever that acts to lock the trigger in the inoperative position. Typically, a young child will attempt to activate the lighter by depressing the trigger only. However, when this is done, the trigger will not move at all or significantly, so that neither a spark nor a flame will be generated. Since the trigger is locked in this position, repeated operation of the trigger by a child will yield the same unsuccessful results.

The only way to activate the lighter is to depress the safety button. When this is done, the cam lever is moved out of the path of the trigger, so that the trigger can now be depressed. Depression of the safety button also causes the fuel-release lever to move, so that, depending on the extent of pressure placed on the safety button, the fuel-release valve may be opened and fuel released. As such, a second significant safety-related feature of the present invention is that a small amount of pressure on the safety button will release the trigger lock. However, such pressure will not release sufficient fuel for a flame to be produced. That is, the most that can happen when the user presses the safety button slightly, and then depresses the trigger, is that a spark would be generated. To ignite the spark, the user would have to continue pressing the safety button further than is required to release the lock, so that sufficient fuel is released before the trigger is activated and a spark and flame are generated.

The above procedure ensures that even if a child were to be able to momentarily press the safety button to release the lock, he or she would still have trouble creating a flame, as doing so would require further pressure on the safety button. This is a simple, yet effective concept. Nevertheless, it is a concept that a young child operating the lighter must recognize and grasp before he or she can successfully operate the lighter. In most cases, the child either will not recognize the usefulness of the safety button or, if he/she does, he/she will not be able to simultaneously press the safety button far enough to create a flame. As such, the child will most likely abandon the lighter after several unsuccessful attempts.

Once the user no longer needs the flame, the trigger is released. At this point, the return spring in the cam mechanism ensures that the cam lever, the fuel-release lever, and the safety button all return to their original stationary positions, thus also automatically re-locking the trigger in the inoperable state.

As can be understood from the above description, the invention disclosed herein achieves its safety objectives without making operation of the lighter any more cumbersome than a regular utility lighter. Specifically, the safety button is positioned in such a way that operation of the lighter is very simple in experienced hands. An adult user familiar with the operation of utility lighters still needs to use only one finger to sustain the flame. This allows the user to operate the lighter in a safe, yet non-complicated manner.

The unique structure of the cam mechanism contained in the present invention provides for an optimum amount of safety as it makes it very difficult, if not impossible, for young children to operate the device. Young children are capable of carrying out only simple mental concepts. As such, a young child wishing to operate the present invention would attempt do so in the usual way, i.e., by pressing the trigger. However, due to the automatic locking mechanism of the device, the trigger will not move. This alone will act as a deterrent as most young children will simply abandon the device after several unsuccessful attempts. This is true because a child operator must first recognize that both the trigger and the safety button must be operated simultaneously before a flame can be generated. This is generally too convoluted a concept for young children to grasp or appreciate.

Nevertheless, even if a young child were to be able to learn the proper operation of the device, he or she would probably still be unable to actually operate the device. Given the relative location of the trigger and the safety button, operation of the present invention requires that the user be able to grasp the handle of the lighter in his or her hand, operate the trigger with the index finger, and simultaneously operate the safety button with the thumb. This, in turn, requires not only a significant amount of manual dexterity, but also hands that are sufficiently large, namely, adult hands. Moreover, successful operation of the device requires an amount of strength and pulp that are rarely found in the fingers of young children.

In addition, even if a child were to possess the mental capacity for understanding and learning the required process of operation, a large enough hand, and the required amount of manual dexterity, strength, and pulp, so that he or she could somehow generate a flame, he or she would have to recognize a second concept: that the flame will not be sustained unless the trigger is held in its activated state. Again, this is a difficult mental concept for a child to recognize and learn. Moreover, even if learned, the concept would be difficult for a child to operationalize given the above discussion regarding the mental and physical limitations of young children. On the other hand, an adult user would have no difficulty operating the invention as the device requires no more than the simultaneous operation of two strategically positioned buttons.

In addition to all of the safety advantages described above, the invention described herein offers a significant reduction in cost, and a significant increase in ease, of manufacturing. The cam mechanism is an integrated, one-piece member that performs the functions of at least three (3) separate members in most other utility lighters currently available on the market. Moreover, the entire safety feature, as well as full operation of the device is generally enabled by the manufacture and use in the lighter of two (1) basic elements: the cam mechanism and the safety button. In addition, it is contemplated that these two elements may even be combined, so that only one integrated structural member need be produced. This, of course, would lead to even more significant savings and simplicity in the manufacturing process.

This and other advantages of the present invention will become more apparent through the following description of the drawings and detailed description of the preferred embodiment.

BRIEF DESCRIPTION OF THE DRAWINGS

FIG. 6 is a perspective view of a prior art lighter; and

FIG. 7 is a cross-sectional view of a prior art lighter.

DETAILED DESCRIPTION OF THE PREFERRED EMBODIMENT

Figure 1:
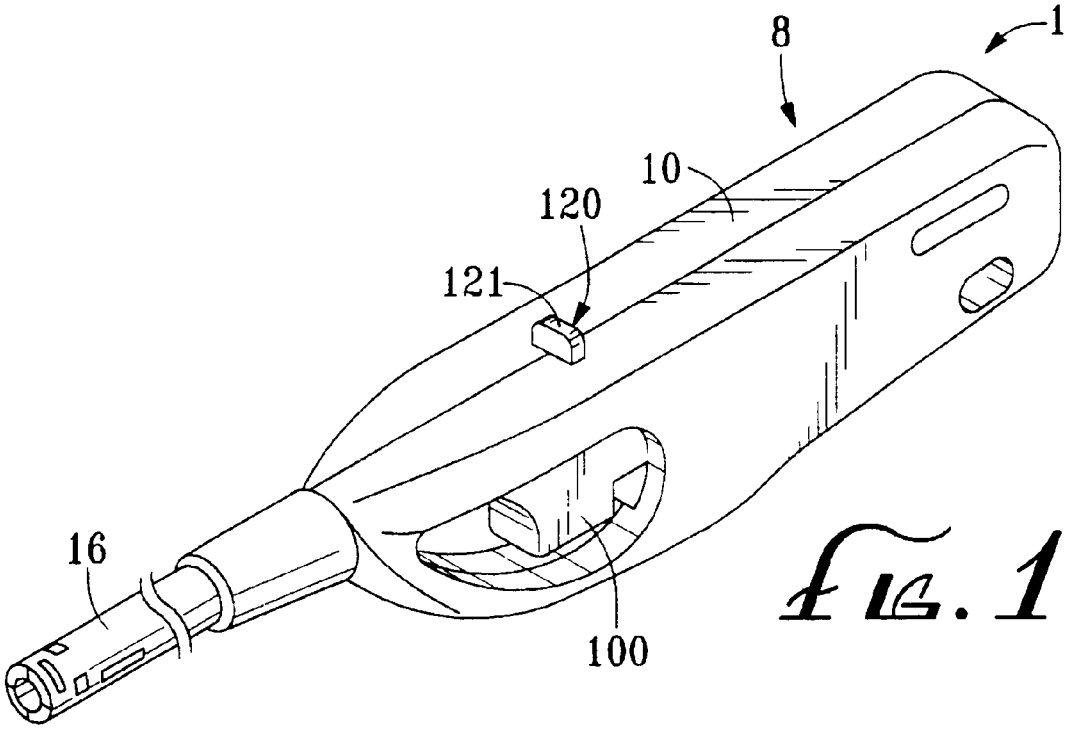
FIG. 1 is a perspective view of the preferred embodiment of the invention.

A general description of the piezoelectric utility lighter (1) (FIG. 1) will be provided before presenting a detailed description of the improvement in the safety feature that constitutes the invention.

Figure 2:
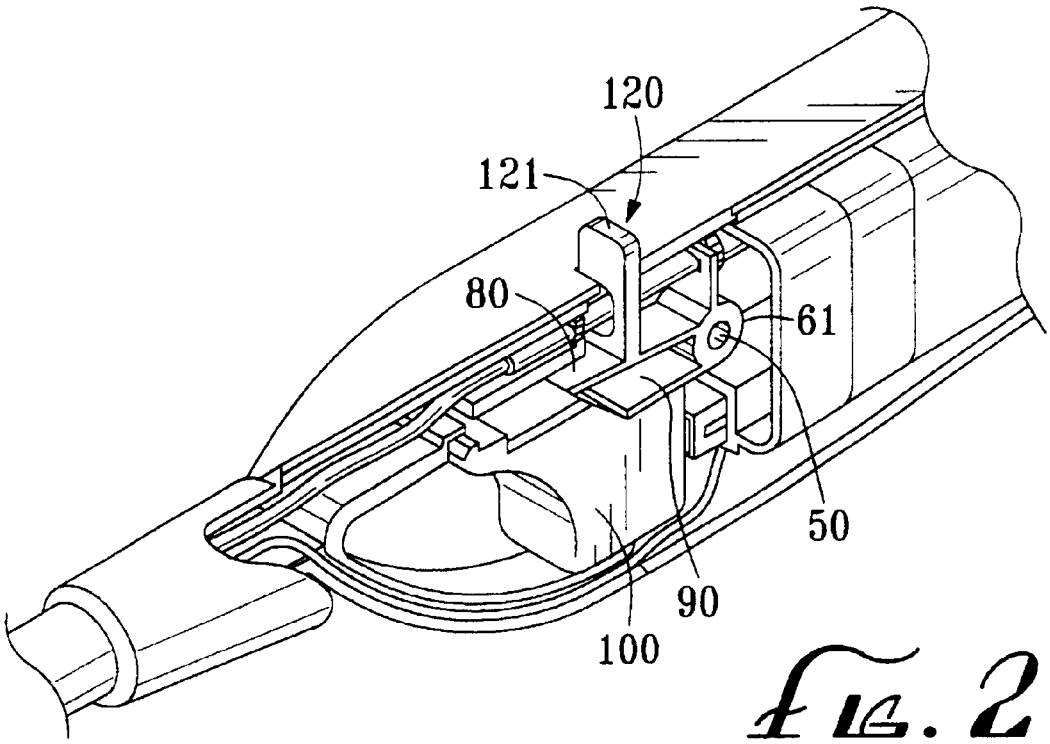
FIG. 2 is a sectional view of the preferred embodiment of the invention.
Figure 3:
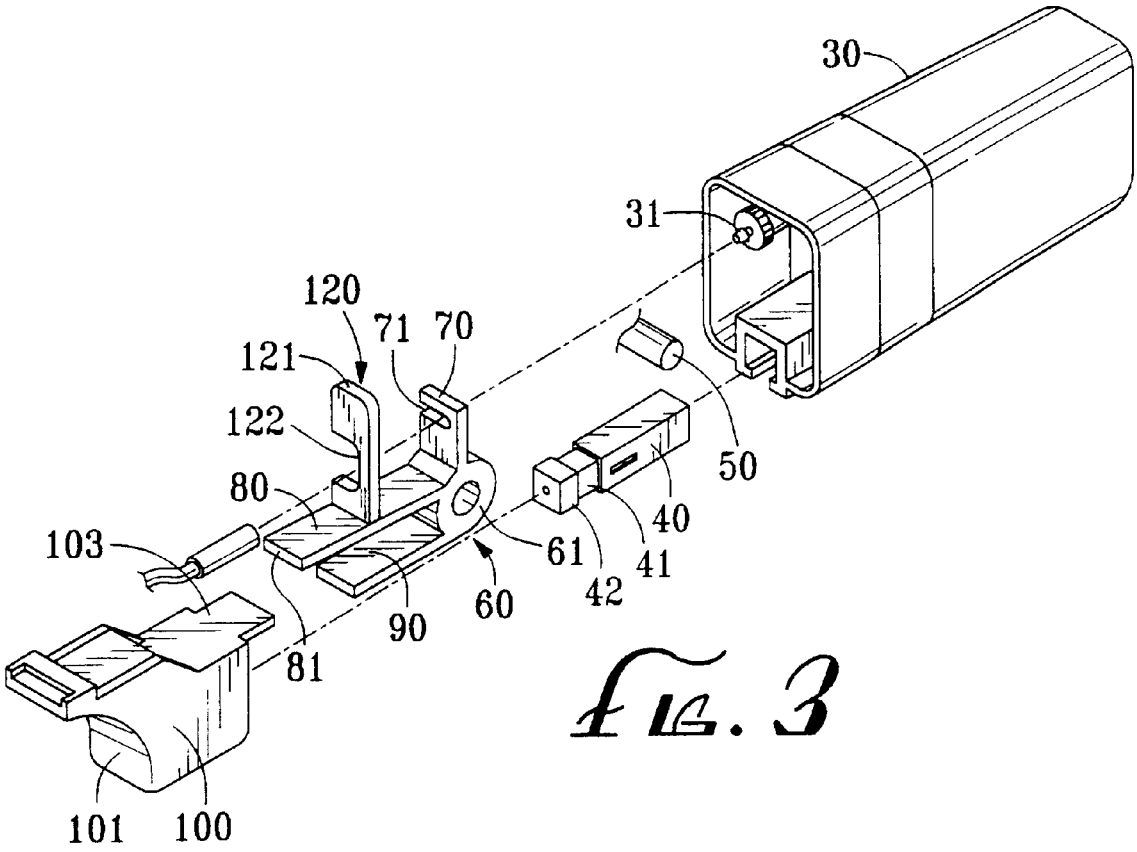
FIG. 3 is an exploded view of the preferred embodiment.

Generally, the elements of the utility lighter (1) include a lighter housing (10), a lighting rod (16) attached to the forward end of the lighter housing via engagement means (not shown), a support ring which slides over the overlapping portions of the lighter housing and lighting rod, a fuel tank (30) (FIGS. 2 and 3), a piezoelectric unit (40), a cam-support pin (50), a cam mechanism (60), a fuel-release lever (70), a cam lever (80), a return spring (90), a trigger (100), a stopper (110), and a safety button (120).

The lighter housing (10) is comprised of two shells, cut along the longitudinal axis of the lighter (1). The lighter housing (10) has a back end and a forward end, where the forward end is equipped with engagement means (not shown) to engage a lighting rod (16). The lighting rod, which typically has a cylindrical cross section, has a free end which constitutes the tip of the lighter (1) and an engagement end which connects to the forward end of the lighter housing. Where the forward end of the lighter housing and the engagement end of the lighting rod overlap, there is provided a support ring (not shown) which slides over and maintains the lighter housing-lighting rod combination.

The lighter (1) is equipped with a fuel tank (30). A fuel-release valve (31) is attached to the fuel tank. This valve is spring loaded so that it is normally urged to the closed position. The valve is also provided with a gas tube (32) which extends through the lighting rod and to a discharge nozzle (not shown) at the free end of the lighting rod. The valve is opened via the operation of a fuel-release lever (70).

The next element of the lighter (1) is a piezoelectric unit (40). The upper section of the piezoelectric unit (40) constitutes the sliding section (41). The sliding section (41) has a contact surface (42) that is in contact the trigger (100). Operation of the piezoelectric unit (40) creates an electric discharge that is carried to the free end of the lighting rod via a wire (not shown).

One of the primary elements of the safety-related invention is a cam mechanism (60). The cam mechanism has a hub (61), as well as three projections that extend in generally different directions. These projections are: a fuel release lever (70), a cam lever (80), and a return spring (90).

The cam mechanism is held in place by a cam-support pin (50). The cam-support pin (50) is a projection that extends from the inner surface of one of the lighter housing shells in a direction that is perpendicular to the longitudinal axis of the lighter (1). The hub (61) of the cam mechanism (60) fits unto and is supported by the cam-support pin (50).

The fuel-release lever (70) is connected to the valve (31) by a C-shaped notch (71) in the fuel release lever, and has an opposing end that is integral with the hub (61) of the cam mechanism (60). The cam lever (80) has one end that is integral with the hub (61) of the cam mechanism (60) and an opposing free end that constitutes the cam-lever edge (81). The return spring (90) also has one end that is integral with the hub (61) of the the cam mechanism (60).

The next primary element is the trigger (100). The trigger (100) is slidably mounted between the two shells of the lighter housing (10). As in conventional utility lighters, the trigger (100) is allowed to slide back and forth along the longitudinal axis of the lighter (1). The trigger (100) has an operation section (101) that protrudes from the lighter housing (10) so as to be operated by a finger of the user. Generally, the operation section (101) has a surface that is slightly curved so as to appear concave. However, the invention described herein is amenable to different degrees of curvature for the operation section (101) of the trigger (100).

The trigger (100) also has an undersurface that makes contact with the contact surface (42) of the sliding section (41) of the piezoelectric unit (40). In addition, the trigger (100) has a trigger tab (103) and a stopper tab (110). The trigger tab (103) is a projection that makes contact with the upper surface of the cam lever (80). The stopper tab (110) is typically placed underneath the trigger tab (103) and engages the cam-lever edge (81).

The next primary element is a safety button (120). The safety button (120) is slidably fitted within the top surface of the lighter housing shell and has an operation section (121). The safety button is integral with the cam lever (80), and the safety button is connected substantially at a midpoint of the cam lever. The safety button (120) has a C-shaped notch (122), which allows the fuel tube to pass by the safety button In the preferred embodiment, the primary elements of the safety-related invention described herein, as well as the interaction between these and the other, more conventional, elements of the utility lighter can be further defined as follows.

Figure 4:
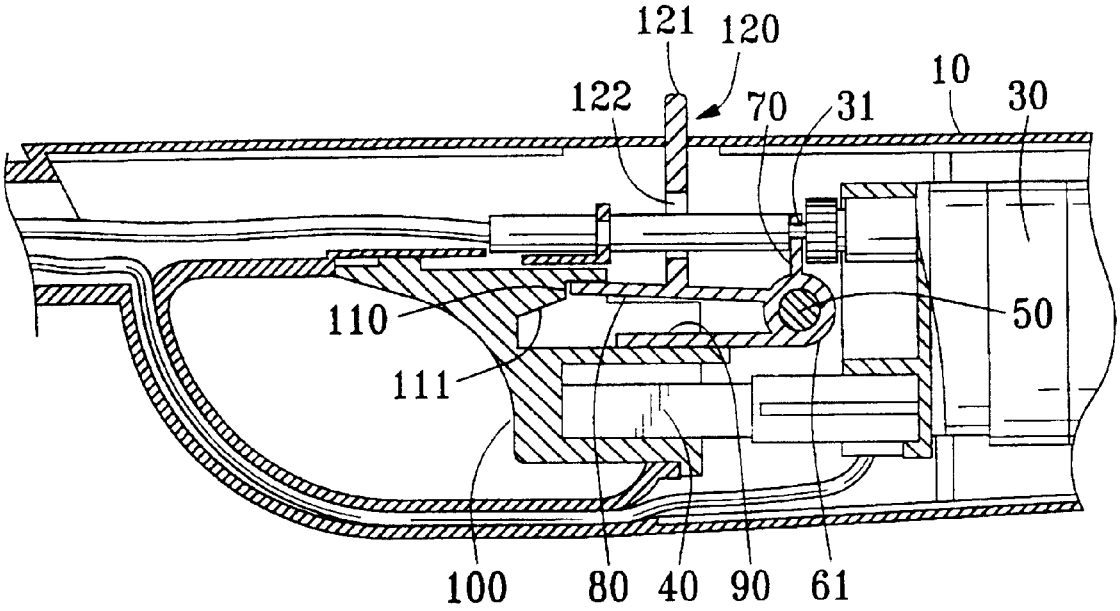
FIG. 4 is a cross-sectional view of the preferred embodiment.
Figure 5:
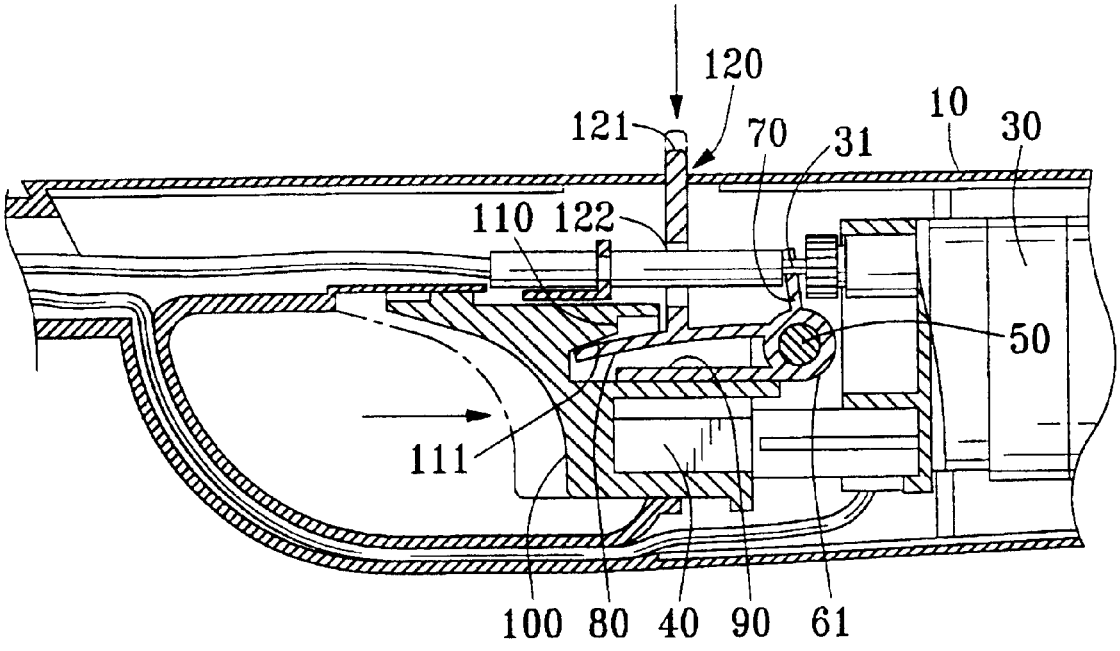
FIG. 5 is a cross-sectional view of the preferred embodiment during operation.

In the preferred embodiment, the hub (61) (FIGS. 4 and 5) of the cam mechanism (60) is fitted unto and supported by the cam-support pin (50), so that the hub (61) is capable of rotating around the cam-support pin (50). In order to operate the lighter (1), the user must press the trigger (100) to create a spark, and release fuel so that a flame can be generated. However, when the user attempts to press the trigger (100), the trigger will not move significantly or at all.

In the inoperable state, the trigger tab (103) is in contact with the upper surface of the cam lever (80). The trigger (100) has a stopper tab (110) that engages the cam-lever edge (81). This acts as a locking mechanism which must be released before the trigger can be moved. To release the lock, the user must press the safety button (120) by pushing on the safety button operation section (121). When the safety button (120) is depressed, the motion of the safety button (120) is translated to the cam lever (80) disengaging the cam-lever edge (81) from the stopper tab (110), and resistance is provided by the return spring (90).

The cam lever (80) moves, so that its cam-lever edge (81) is disengaged from the stopper tab (110), once they are disengaged the trigger (100) can be pulled. Once the trigger is pulled the cam-lever edge contacts the inclined surface (111), and as the cam-lever edge moves along the inclined surface, the cam mechanism continues to rotate and opens the fuel-release valve (31).

With the locking mechanism disengaged, the user can now press the trigger (100) in order to create a spark. As the operation section (101) of the trigger (100) is pushed, the undersurface (102) of the trigger (100) contacts the contact surface (42) of the sliding section (41) of the piezoelectric unit (40). In this way, as the trigger (100) is activated, so is the piezoelectric unit (40), so that a spark is generated when the sliding section (41) has moved back far enough.

This, in turn, causes further rotation of the hub (61), which causes the fuel-release lever (70) to open the fuel-release valve (31) and release fuel. Once the flame is no longer needed, the trigger (100) is released. This allows both the cam lever (80) and the fuel-release lever (70) to return to their stationary positions under the urging influence of return spring (90). Once in this position, the cam-lever edge (81) again engages the stopper tab (110), thereby automatically re-locking the lighter.

I claim:

1. A utility lighter having a lighter housing, a lighting rod projecting from the lighter housing, a gas tank located within the lighter housing having a fuel release valve connected to a gas tube that extends through the lighting rod, and a piezo unit capable of igniting fuel released from said tank, the improvement comprising:

a trigger and a safety button at least partially contained within said lighter housing, said safety button having an operational end capable of engaging said trigger and said release valve;

said trigger being slideably mounted in said lighter housing and said trigger being capable of operating said piezo unit independently of said safety button;

said safety button and said trigger capable of operating said release valve in unison when said safety button and said trigger are depressed at the same time; and, when said safety button is in an undepressed position, said operational end of said safety button blocks said trigger from activating said release valve.

2. The utility lighter as in claim 1 wherein said operational end includes a cam mechanism having a hub and at least two projections extending in different directions; and, said two projections being a fuel-release lever for engaging said valve and a cam lever for engaging said trigger whereby depression of said safety button causes said cam lever to move out of interference with said trigger and said fuel-release lever to open said valve.

3. The utility lighter as in claim 2 wherein said cam mechanism is supported by a cam-support pin for supporting the hub of the cam mechanism, the cam-support pin projecting from an inner surface of the lighter housing in a direction perpendicular to a longitudinal axis of the lighter.

4. The utility lighter as in claim 3 wherein the fuel-release lever has a first and a second end, the first end capable of opening the fuel release valve and the second end being integral to the cam mechanism.

5. The utility lighter as in claim 1 wherein said operational end includes a cam mechanism having a hub and three projections extending in different directions therefrom, said three projections being a fuel-release lever for engaging said valve, a cam lever for engaging said trigger whereby depression of said safety button causes said cam lever to move out of interference with said trigger and said fuel-release lever to open said valve, and a return spring.

6. The utility lighter as in claim 5 wherein said cam mechanism is supported by a cam-support pin for supporting the hub of the cam mechanism, the cam-support pin projecting from an inner surface of the lighter housing in a direction perpendicular to a longitudinal axis of the lighter.

7. The utility lighter as in claim 6 wherein the fuel-release lever having a first and a second end, the first end is connected to the fuel release valve and the second end is integral to the cam mechanism.

8. A utility lighter having a lighter housing, a lighting rod projecting from the lighter housing, a gas tank located within the lighter housing having a fuel release valve connected to a gas tube that extends through the lighting rod, and a piezo unit capable of igniting fuel released from said tank, the improvement comprising:

a trigger and a safety button at least partially contained within said lighter housing, said safety button capable of engaging a cam mechanism having at least two projections extending in different directions, said two projections being a fuel-release lever for engaging said valve and a cam lever for interfering with movement of said trigger;

said safety button biased in a locked position wherein said cam lever is positioned to interfere with said trigger and said safety button capable of being moved to an unlocked position that causes said cam lever to move out of interference with said trigger and said fuel-release lever to open said valve; and, said trigger being capable of engaging said piezo unit whereby fuel is ignited when said trigger and said safety button are operated simultaneously.

9. The utility lighter as in claim 8 wherein the cam mechanism includes a hub from which said projections extend.

10. The utility lighter as in claim 9 wherein said hub is supported on a cam-support pin, said cam-support pin projecting from an inner surface of said lighter housing in a direction perpendicular to a longitudinal axis of the lighter.

11. The utility lighter as in claim 9 wherein a third projection extends from said hub to bias said safety button in a locked position.

* * * * *